US012195906B2

(12) United States Patent
Schaumann et al.

(10) Patent No.: US 12,195,906 B2
(45) Date of Patent: Jan. 14, 2025

(54) METHOD OF OPERATING A WASHING MACHINE AND WASHING MACHINE

(71) Applicant: E.G.O. Elektro-Geraetebau GmbH, Oberderdingen (DE)

(72) Inventors: Uwe Schaumann, Oberderdingen (DE); Wolfgang Thimm, Karlsruhe (DE)

(73) Assignee: E.G.O. ELEKTRO-GERAETEBAU GMBH, Oberderdingen (DE)

( * ) Notice: Subject to any disclaimer, the term of this patent is extended or adjusted under 35 U.S.C. 154(b) by 250 days.

(21) Appl. No.: 17/809,980

(22) Filed: Jun. 30, 2022

(65) Prior Publication Data

US 2023/0013628 A1 Jan. 19, 2023

(30) Foreign Application Priority Data

Jul. 13, 2021 (DE) ..... 10 2021 207 441.3

(51) Int. Cl.
*D06F 34/24* (2020.01)
*D06F 23/02* (2006.01)
(Continued)

(52) U.S. Cl.
CPC ..... *D06F 34/24* (2020.02); *D06F 23/02* (2013.01); *D06F 33/32* (2020.02); *D06F 34/18* (2020.02);
(Continued)

(58) Field of Classification Search
CPC ..... D06F 23/02; D06F 34/18; D06F 34/24; D06F 2103/04; D06F 2103/06; D06F 2103/16
See application file for complete search history.

(56) References Cited

U.S. PATENT DOCUMENTS 6,629,439 B2 10/2003 Woebkemeier
9,243,987 B2 1/2016 Chanda et al.
(Continued)

FOREIGN PATENT DOCUMENTS

DE 19855503 A1 6/2000
DE 102006014515 A1 9/2007
(Continued)

OTHER PUBLICATIONS

European Patent Office, Extended European Search Report received for Application No. 22179938.0, dated Dec. 8, 2022, 9 pages, Germany.
(Continued)

*Primary Examiner* — Joseph L. Perrin
(74) *Attorney, Agent, or Firm* — Alston & Bird LLP

(57) ABSTRACT

A washing machine has a rotatable drum and drum drive and a drum container for it, an inlet device to introduce water into the drum onto laundry therein, a pump and water pipes, several temperature sensors on the drum container, a heater for heating water and a washing machine controller connected to everything. Laundry in the drum is moistened with a defined quantity of water, wherein the moisture penetration varies depending on the fiber type of the laundry. Then a predefined quantity of water with a predefined temperature is applied to this laundry. The washing machine controller can deduce the fiber type of the laundry from the way how quickly and to what extent heat is extracted from this quantity of water.

25 Claims, 3 Drawing Sheets

(51) Int. Cl.

| | |
|---|---|
| ***D06F 33/32*** | (2020.01) |
| ***D06F 34/18*** | (2020.01) |
| ***D06F 39/04*** | (2006.01) |
| ***D06F 39/08*** | (2006.01) |
| *D06F 103/04* | (2020.01) |
| *D06F 103/06* | (2020.01) |
| *D06F 103/16* | (2020.01) |
| *D06F 105/10* | (2020.01) |

(52) U.S. Cl.
CPC ..... *D06F 39/04* (2013.01); *D06F 39/088* (2013.01); *D06F 2103/04* (2020.02); *D06F 2103/06* (2020.02); *D06F 2103/16* (2020.02); *D06F 2105/10* (2020.02)

(56) References Cited

U.S. PATENT DOCUMENTS

| | | | | |
|---|---|---|---|---|
| 10,260,505 | B2 | 4/2019 | Block et al. | |
| 10,323,351 | B2 | 6/2019 | Weiss et al. | |
| 11,230,803 | B2 * | 1/2022 | Hombroek | D06F 35/006 |
| 11,371,175 | B2 * | 6/2022 | Hombroek | D06F 34/06 |
| 11,866,868 | B2 * | 1/2024 | Hombroek | G06T 7/90 |
| 11,898,289 | B2 * | 2/2024 | Hombroek | D06F 33/34 |
| 2007/0289607 | A1 | 12/2007 | Kim et al. | |
| 2018/0080164 | A1 | 3/2018 | Hoppe et al. | |
| 2020/0048813 | A1 | 2/2020 | Schaumann et al. | |
| 2022/0145517 | A1 | 5/2022 | Schaumann et al. | |

FOREIGN PATENT DOCUMENTS

| | | | |
|---|---|---|---|
| DE | 102011003467 | A1 | 8/2012 |
| DE | 102014104635 | A1 | 11/2014 |
| DE | 102013211180 | A1 | 12/2014 |
| DE | 102014220021 | B3 | 2/2016 |
| DE | 102020213968 | B3 | 2/2022 |
| EP | 1870504 | B1 | 5/2010 |
| EP | 3144425 | A1 | 3/2017 |
| EP | 3608466 | A1 | 2/2020 |
| EP | 3777639 | A1 | 2/2021 |
| WO | WO 92/09017 | A1 | 5/1992 |

OTHER PUBLICATIONS

German Patent and Trade Mark Office, Office Action received for Application No. DE 102021207441.3, dated Dec. 13, 2021, 6 pages, Germany.

* cited by examiner

METHOD OF OPERATING A WASHING MACHINE AND WASHING MACHINE

CROSS-REFERENCE TO RELATED APPLICATIONS

This application claims priority to Germany Application No. 10 2021 207 441.3, filed Jul. 13, 2021, the contents of which are hereby incorporated herein in its entirety by reference.

Field of Application and Prior Art

The invention relates to a method for operating a washing machine and a washing machine designed to carry it out. In particular, it should be possible to determine a type of laundry or fiber type of laundry that is mainly or exclusively in the washing machine, so that a washing program can be adapted to it in different advantageous ways.

It is known from EP 3144425 A1 to monitor moisture and/or temperature profiles when drying laundry in a tumble dryer. From these curves and from a comparison of an actually recorded curve with curves stored in a tumble dryer controller, which are recorded for different types of fibers, the specific type of fiber that is predominantly or exclusively present in the laundry can then be determined.

It is known from EP 3608466 A1 to determine a fiber type of laundry in a tumble dryer by monitoring the behavior of tumbled laundry when the tumble dryer is rotated. Here, too, a curve actually measured or a number of curves is compared with curves stored in a tumble dryer control.

OBJECT AND SOLUTION

The invention is based on the object of creating a method as mentioned at the outset and a washing machine designed to carry out this method, with which problems of the prior art can be solved, and in particular it is possible to determine a type of fiber from laundry in the washing machine and laundry to be washed. This then forms the basis for a coordinated, optimized washing method or washing program.

This object is achieved by a method having the features of claim 1 and by a washing machine having the features of claim 16. Advantageous and preferred configurations of the invention are the subject matter of the further claims and are explained in more detail below. Some of the features are only described for the method or only for the washing machine. However, independently of this, they should be able to apply both to the method and to a corresponding washing machine for carrying it out independently, and without relying on one another. The wording of the claims is made part of the content of the description by express reference.

The washing machine has a rotatable drum with a drum drive that can rotate the drum as required. The drum is water-permeable or has a water-permeable wall and has a drum container in which the drum is arranged, so that the drum container surrounds the drum. Such a drum is usually perforated or provided with openings on the outer circumference, and possibly with carriers or the like on the inside. The drum container is non-rotatable and surrounds the drum, wherein it is substantially sealed. In the lower area, it can have a conventional sump, and it can also advantageously be designed without a sump. Furthermore, an inlet device is provided in order to bring water into the drum onto the laundry located therein. A so-called circulation washing machine is advantageous, in which water is not simply allowed into the drum container, so that the water level in the drum then also rises accordingly. Rather, the inlet device applies the water directly to the laundry located in the drum, for example by means of injection nozzles or spray devices. These can be rigid, alternatively they can also have a controllable direction for the targeted application of the water to the laundry, as is known, for example, from EP 3777639 A1. Furthermore, at least one temperature sensor is provided, which can be arranged on the drum container, advantageously on the outside, alternatively also a temperature sensor on a water pipe, possibly behind the drum container. It should record the temperature in this area as well as possible, in particular of water that impinges on the drum container in its area or which is located there. Several temperature sensors are advantageously provided, which will be explained in more detail below.

Furthermore, at least one pump and water pipes are provided to pump water in the washing machine and especially to the inlet device. A conventional and advantageous pump can be used for this purpose. This is explained in more detail below. The water pipes can be rigid or flexible, so they can include both rigid pipes and flexible hoses. Furthermore, valves are advantageously provided in order to control a water flow.

A heating device for heating water in the washing machine is provided so that a suitable and optimal temperature for the water can be set depending on the selected method or washing program. Furthermore, the heating device is also used for the method according to the invention, as will be explained in more detail below. The washing machine also has a washing machine controller which is connected to the temperature sensor, the pump, the heating device and the drum drive. This washing machine controller advantageously controls all methods in the washing machine, for example also dosing of detergent, and thus it also carries out the method according to the invention. It can also be connected to the aforementioned valves in the washing machine in order to control them in order to set a desired water flow.

According to the invention, the following steps are carried out in the method. Initially, dry laundry is placed in the drum or is already in it. Dry laundry is advantageously understood to mean laundry that is completely dry or which contains no residual moisture. In particular, it is laundry that is as dry as if it had been dried for such a long time at normal humidity, advantageously 30% to 70% or 40% to 60%, in a living room or a laundry room, such that its dryness or moisture content no longer change. This defined condition of the laundry is advantageously used in order to have defined starting conditions.

In a further step, the weight of the laundry in the drum is determined or is known, or it is ensured as a result that the washing machine controller knows the weight of this dry laundry. Methods for this are known. Under certain circumstances, a user can also enter it manually. This is also considered important in order to have defined and known conditions for carrying out the method according to the invention. The method should be able to be carried out for different quantities or weights of laundry.

In a subsequent step, the laundry in the drum is moistened. This is advantageously done with a defined quantity of water or up to a defined degree of moisture penetration. This may possibly be related to and dependent on the weight of the laundry, for example a proportional quantity of water. The ratio can be 1:3, for example 1 kg of water for 3 kg of laundry. Alternatively, it can be a specific predefined value of a physical parameter, for example a specific electrical conductivity of the soaked laundry. A degree of moisture penetration can be such, for example, that after setting a water level in the lower area of the drum container in a subsequent step, which takes place by pumping, water has dripped out of the laundry for a predefined period of, for example, 1 minute to 10 minutes. By pumping out the water at the bottom of the drum container in such a way that the drum and thus the laundry in it are no longer immersed in standing water, advantageously by pumping the lower area of the drum container completely empty, the quantity of water in the washing machine can be set or reduced to a relatively precisely known or defined quantity. The empty pumping of the drum container can be detected, for example, by the pump's operating behavior; alternatively it can be detected by water or level sensors. As a result, a quantity of water remains in the laundry as moisture penetration, which does not drip out so easily or is stored by the laundry for the time being. This quantity of water in the laundry depends on the type of fiber in the laundry; with cotton it is relatively high and with synthetic fibers it is relatively low.

In a subsequent step, a predefined quantity of water is brought to a predefined temperature by means of the heating device. Advantageously, the pump is also used for this purpose, for example it can pump this quantity of water several times through the heating device or past the heating device for heating, for example circulating or oscillating or rocking back and forth, so to speak. If the predefined quantity of water has reached the predefined temperature, which can advantageously be monitored and detected by a corresponding temperature sensor, it is applied to the laundry in the drum by means of the pump through the water pipes and through the inlet device. From this point in time, a temperature is detected at the temperature sensor arranged on the drum container, advantageously at all temperature sensors arranged on the drum container or the water pipes. The measured temperatures or temperature curves are monitored and recorded by the washing machine controller; if necessary, they are recorded or stored.

The heated water, which has been brought from the inlet device into the drum and onto the laundry, runs out of this laundry again immediately or quickly, in particular in a maximum of 5 seconds to 10 seconds, and then collects at the bottom of the drum container. There, it is pumped out of the drum container by means of the pump; advantageously, it is pumped out permanently after the pump has pumped the predefined quantity of water into the drum at the predefined temperature. As soon as the pump pumps water out of the lower area of the drum container, this water is advantageously no longer heated. However, this water can then be applied directly from the pump again to the drum and onto the laundry located therein by means of the inlet device. This step described above is either carried out at least once, preferably at least twice to five times, or it is carried out until a total of at least two to five times the predefined quantity of water has been pumped out of the drum container by the pump and applied back to the laundry. The heated water thus circulates in the washing machine through the drum and through the laundry inside. In other words, a predefined quantity of water is heated to a predefined temperature and then applied to the dampened or thoroughly dampened laundry. After that, there is no further heating, but this quantity of water with a defined temperature circulates several times, so to speak, or runs through the washing machine and the laundry several times. The water is advantageously applied to the drum by means of the inlet device in such a way that it always hits the laundry first, runs through it, so to speak, or penetrates it and only then collects at the bottom of the drum container. During this entire process, the at least one temperature sensor on the drum container records, in particular all temperature sensors record, the course of the temperature. In particular, it can be recorded how this temperature changes in a foreseeable manner, specifically qualitatively. This is mainly because the damp laundry extracts its heat from this water due to its heat capacity and the fact that its temperature is lower than that of the water. It is true that the pump, the water pipes and the drum container as well as the drum itself can and do extract heat from the water. However, these influences are known because they are always the same for one and the same washing machine. In particular, they are the same in each case due to their design. Since this can either be calculated out or is no longer noticeable in recorded curves for different fiber types in the laundry due to the always same influence, this principle can be used to determine the main or sole fiber type of laundry in the washing machine. The heat capacity of dry laundry also depends on the type of fiber used. Roughly speaking, laundry has a heat capacity of around 1.5 to 2.5 kJ/kgK, so this difference is not that big. Cotton tends to be at the lower end, linen at the upper end, and synthetic fibers such as polyester, polyamide and polyacrylic in between. However, water has a significantly higher heat capacity of 4.18 kJ/kgK, i.e., about twice as high. However, the method is carried out with damp laundry, namely with a defined and known damp or thoroughly damp laundry.

This is how the heat capacity of damp laundry is determined, and this depends more on the quantity of water stored than on the type of fiber used, i.e., the laundry itself. And here it should be noted that cotton stores considerably more water than the other types of fibers. Damp laundry made of cotton therefore has a relatively high thermal capacity for laundry. The aforementioned synthetic fibers store very little water. Damp laundry made from synthetic fibers therefore has a relatively low thermal capacity for laundry. This can be recognized with the invention. Depending on the existing thermal capacity of the damp laundry in the drum, heat is extracted from the defined quantity of water supplied, and its temperature thus drops from the initially defined temperature. If the temperature drops quickly and for a little longer, the laundry has a high thermal capacity, i.e., it is more likely to be cotton. If the temperature drops slowly and for a shorter period of time, the laundry has a low heat capacity and is more likely synthetic fibers. If water that is warm in a defined manner is therefore applied to the soaked laundry several times or over a certain period of time, the temperature of the water that emerges from this soaked laundry again can be measured and this will rise. The temperature will rise from room temperature or from the temperature that the soaked laundry has before the warm water is applied, since the relatively cold laundry initially extracts a great deal of heat from the relatively warm water supplied. The temperature then rises to a maximum value, wherein it cannot rise higher than the initial defined temperature to which the predefined quantity of water has been heated.

In the following, it is then still a question of using the detected and recorded temperature curves of the at least one temperature sensor on the drum container to determine which fiber type the laundry in the drum predominantly or exclusively has. For this purpose, the washing machine controller has a memory in which temperature curves for temperatures at the at least one temperature sensor are stored, which have been recorded when carrying out the method according to the aforementioned steps with the same predefined quantity of water and the same predefined water temperature. These stored temperature curves do not necessarily have to have been carried out specifically with this washing machine. It is sufficient here if they have been recorded as examples based on the type or design and have then been stored in said memories. The temperature curves are divided into groups or they are grouped. Several groups of temperature curves have been stored as one parameter for different weights of dry laundry. This is considered to be necessary and advantageous in order to be able to measure as well as possible, depending on the weight of the laundry present, divided into stages depending on the weight, for example in 100 gram stages or 500 gram stages. Finally, the total thermal capacity and water absorption capacity of the laundry in the drum also depends very much on the quantity of laundry, i.e., on its weight. The minimum weight can be 1 kg or even just 0.5 kg. The maximum weight can be from 5 kg to 7 kg, depending on the capacity of the drum.

A further grouping of the temperature curves is a subdivision of the stored temperature curves into subgroups for at least two different types of fibers in the laundry. These at least two different fiber types are synthetic fibers or polyester on the one hand and cotton on the other. These are the most commonly used fiber types. Advantageously, further fiber types can be provided for subdivision, for example polyamide, polyacrylic, linen, silk or wool. For these subgroups, each with the same type of fiber in the laundry, the method is carried out exactly as before for the different weights, and the temperature curves are recorded or captured and stored on the at least one temperature sensor on the drum container, preferably on all temperature sensors on the drum container.

A large number of known temperature curves are therefore stored in the memory. In a further step, the washing machine controller then compares the temperature curve recorded for the at least one temperature sensor with all of the stored temperature curves, wherein the known weight of the dry laundry in the washing machine from the first method step is used to look up the group of temperature curves that corresponds to the weight. This takes place in the last step, and there, in the corresponding group of equal weight, the stored temperature curve is searched for, which most closely or best matches or is the same as the captured and recorded temperature curve. The washing machine controller designed for this purpose can then conclude from this that the main or sole type of fiber on which the stored temperature profile found is based also applies to the laundry in the drum in the present case. The laundry is thus defined with the main or sole fiber type of this corresponding or corresponding temperature profile.

In a highly simplified form, it can be said that, in the case of the invention, laundry in the drum is saturated with a defined quantity of water, wherein the moisture penetration is different depending on the fiber type of the laundry. Then a predefined quantity of water with a predefined temperature is applied to this laundry. The washing machine controller can deduce the fiber type of the laundry from the way how quickly and to what extent heat is extracted from this quantity of water. The temperatures are measured with temperature sensors on the drum container.

Advantageously, in the embodiment of the method, it can be taken into account that laundry is often not only intended to be washed together with a single type of fiber. Either the laundry can have a mixed fabric made of different fiber types anyway. Alternatively, items of laundry that each consist exclusively of one type of fiber but have different types of fibers from one another can be placed together in the drum. Thus, a further subdivision of the stored temperature curves, i.e., also for their detection, can be provided, specifically into different subdivisions of the proportions between two or more different fiber types. This is advantageously done for different proportions of cotton on the one hand and polyester or polyamide or synthetic fibers on the other. For example, these proportions can vary in 10% increments, starting with 10% cotton and 90% polyester/polyamide to 90% cotton and 10% polyester/polyamide. Admittedly, it is not very probable that a temperature curve that is actually captured and recorded when the method is carried out exactly matches a single stored temperature curve, so that the laundry in the drum actually only has exactly this fiber or this division of fiber types. However, an approximate association is possible, especially when there are several fiber types, and is considered sufficient.

In a further embodiment of the invention, the predefined quantity of water, possibly also the predefined water temperature, is adapted to the determined weight of the dry laundry at the beginning of the method, and it can be selected differently in each case. At least for the predefined quantity of water, it can advantageously apply that it is larger the higher the determined weight of the dry laundry in the drum, i.e., the more laundry there is. This can advantageously be proportional and not just simply more water for more laundry and less water for less laundry. For example, the predefined quantity of water can be between 20% and 100% of the weight of the dry laundry, particularly advantageously between 30% and 70%.

In an advantageous embodiment of the invention, two temperature sensors are provided, preferably provided on the drum container and arranged at different heights, i.e., at different vertical heights. These two temperature sensors can be arranged along a water pipe and/or on the drum container. In an advantageous embodiment of the invention, two temperature sensors are arranged at different heights on the drum container, and each of them produces its own temperature curve, which is recorded. By distinguishing according to vertical height, a better differentiation of the fiber types of the laundry can possibly be made depending on the existing weight of laundry. With a temperature sensor on the water pipe behind the drum container, the temperature of the water can be monitored at yet another point and a temperature curve can advantageously also be recorded and recorded.

A predefined quantity of water can be between 0.21 and 51, advantageously it is 0.51 to 21 or 0.751 to 1.251. Such quantities of water can easily be heated in the washing machine to the predefined water temperature before the water is then applied to the laundry. Alternatively, the quantity of water can be determined in proportion to the weight of the dry laundry, for example at 20% to 100%, advantageously at 50% to 90%.

The predefined temperature can be 25° C. to 70° C., advantageously 30° C. to 40° C. or up to 45° C. Thus, on the one hand, very high temperatures can be avoided, which could possibly damage certain types of fiber, and the type of fiber is not known at the beginning of the method. On the other hand, of course, the higher the temperature, the higher the energy consumption. Finally, heating to higher temperatures also takes longer than heating to lower temperatures.

In an embodiment of the invention, it can be provided that a complete pumping of the predefined quantity of water out of the drum or out of the drum container by the pump and the drum back in takes 1 second to 10 seconds, preferably 2 seconds to 5 seconds. This is then essentially the circulation time of a water molecule. By pumping the water around relatively quickly, the heat dissipation from the heated water to the water pipes or other parts of the washing machine can be reduced. The influence of the laundry itself on the temperature of the water or its change then increases, which is desirable for increased accuracy.

In an advantageous development of the invention, the drum is rotated at least temporarily, in particular permanently, during the method, in particular while the heated water is being applied to the laundry and, above all, afterwards. A number of revolutions can be from 50 to 1,800 revolutions per minute or a maximum number of revolutions of the washing machine. A medium or rather low number of revolutions is advantageously selected, in particular from 400 to 800 revolutions per minute. In this respect, it can be provided in an embodiment of the invention that the drum is rotated so quickly that, on the one hand, the laundry lies distributed on the drum due to the centrifugal force. The laundry is advantageously evenly distributed. On the other hand, the number of revolutions of the drum can be selected in such a way that the water applied to the laundry does not run down inside the drum and only through the laundry lying at the bottom into the drum container, but by rotating in the radial direction, i.e., also through the centrifugal force, passing outwards through the laundry. In this way, as much water as possible should reach all areas of the drum container and thus also all temperature sensors provided here for precise temperature measurement.

In the case of the aforementioned pumping, the water is preferably continuously circulated or pumped during the method, in particular with the pump output being as constant as possible. In the further course of the method, the quantity of water applied to the laundry by the inlet device can be somewhat smaller than when the predefined quantity of water at the predefined temperature was applied for the first time. After that, it should at least remain as constant as possible. The pumped quantity of water can advantageously be detected on the pump itself, advantageously on the basis of its operating data. This is known from the prior art.

In a further embodiment of the invention, before the introduction of the predefined quantity of water with the predefined temperature, there should be no warm water in the drum container, in particular if possible no water at all. Thus, a sump formed at the bottom of the drum container should be as empty as possible. If water has run out when the laundry is soaked and is collected here, it should be removed. In this way, a falsifying influence on the method of water still in the system, the heat capacity of which is very high, can be reduced or completely avoided. That would be harmful, since its quantity and temperature are unknown and not related to the fiber type of the laundry. The of water in the laundry should be characteristic of the fiber type of this laundry quantity; excess quantities of water should advantageously be removed.

In an advantageous embodiment of the invention, it can be provided that, to heat the predefined quantity of water to the predefined temperature, the pump pumps the appropriate quantity of water multiple times through the heating device without reaching the inlet device or the drum container. Thus, the entire quantity of water does not have to be heated in one place or in one container, so to speak, for example similar to a heatable water container, which is also possible per se. Rather, the water can be pumped by the pump either circulating or with alternating flow direction through or past the heater, depending on what results in heating. It is preferably possible that the water can circulate, i.e., run around, along a type of circulating water pipe, which is either provided and necessary for the function of the washing machine anyway or which is at least partially provided only for this purpose and which can also be enlarged for this purpose, for example. In this way, it can be heated a little more each time it flows through or past the heating device. If this is a closed water circuit, so to speak, then the full heating capacity can be introduced into the predefined quantity of water permanently, so to speak.

With an alternating direction of flow of the predefined quantity of water through the heating device, a water container can be provided in the washing machine, which is advantageously thermally insulated and which is intended for the pump to flow out of and into it when the predefined quantity of water is heated to the predefined temperature the water pumps in and out again. The water flows past the heating device at least once, advantageously both times. Here, too, water is heated virtually most of the time or even all of the time by being heated by means of the heating device. The course of the temperature and in particular the attainment of the predefined temperature can be precisely monitored by a suitably cleverly arranged temperature sensor, advantageously on the pump, on the heating device or on a water pipe or the aforementioned water container. In this way, water can be rocked back and forth, so to speak, wherein it can advantageously even run through the pump. When designed as an impeller pump, it cannot pump in both directions except by using multiple valves so as to direct the flow of water through the pump in the same way, but through the water pipes in a different way. However, if the pump pumps the water to an elevated section of a water pipe or water container and then stops pumping, the water may circulate back through the pump on its own. This is described in DE 102020213968.7 with the filing date of Nov. 6, 2020 from the same applicant, to which express reference is hereby made.

Said water container holds at least half of the predefined quantity of water or the maximum predefined quantity of water. The rest can be in the water pipes, so to speak. The water container advantageously holds the predefined quantity of water or the entire maximum quantity of water. In this way, the heating of this quantity of water to the predefined temperature can be carried out with maximum advantage by sustained or frequent pumping with simultaneous heating.

In an advantageous embodiment of the invention, a temperature sensor can be arranged on the pump and/or on the heating device. This can be used to record the temperature of the water flowing through or being pumped through. In the washing machine controller, the heating energy used up to now or introduced into the water can then also be calculated as the heating power times the duration of the heating. A temperature sensor can be provided in an integrated form, for example, on the pump and/or on the heating device, for example as a fixed component thereof. A temperature sensor can be provided as a protective mechanism for just one heating device in order to protect it from overheating. This temperature sensor can also be used to detect and record a temperature and then compare it with a stored temperature profile, similar to what was initially described for the at least one temperature sensor that can be arranged on the drum container.

In an advantageous embodiment of the invention, the heating device, in particular together with the temperature sensor, is integrated into the pump. Such a pump with integrated heating is known, for example, from DE 102013211180 A1, to which explicit reference is hereby made.

In a further advantageous embodiment of the invention, it can be provided that the aforementioned temperature sensor is arranged on the outside of the drum container as the first temperature sensor in the height area of the lower half of the drum container. Another temperature sensor is arranged as a second temperature sensor at the vertical level of the upper half of the drum container and on the outside thereof. The lower first temperature sensor is advantageously arranged at least 10% of the vertical height of the drum container above its lowest point, preferably 20% to 40% of its height. The upper second temperature sensor can be placed at the appropriate vertical height, namely 60% to 80% or even 90% of the vertical height of the drum container.

Yet another temperature sensor is advantageously arranged on a water pipe leading to the inlet device and in front of it in the direction of flow. In this way, the temperature of the water can also be recorded and possibly checked before it is applied to the laundry by means of the inlet device. A distance between the temperature sensor and the inlet device is advantageously less than 10 cm or even less than 5 cm. At this short distance, a noteworthy or noticeable temperature drop when flowing through is hardly to be expected.

The method can be carried out primarily for the purpose of being able to check whether a program set by a user on the washing machine matches the laundry or type of fiber that is actually present. For example, if a high-temperature program is set because the user assumes that the laundry is made of cotton, but the washing machine determines that the laundry is mainly or entirely made of synthetic fibers or delicate wool, the washing machine may issue an error message or a warning. Alternatively, it can automatically reduce the temperature so as not to damage synthetic or wool laundry.

These and other features emerge from the claims, the description and the drawings, wherein the individual features are implemented individually or in combination in the form of sub-combinations in one embodiment of the invention and in other areas and may represent designs that are advantageous and protectable in their own right, for which protection is claimed here. The subdivision of the application into individual sections and subheadings does not limit the general validity of the statements made thereunder.

BRIEF DESCRIPTION OF THE DRAWINGS

Exemplary embodiments of the invention are shown schematically in the drawings and are explained in more detail below. In the drawings.

DETAILED DESCRIPTION OF THE EXEMPLARY EMBODIMENTS

Figure 1:
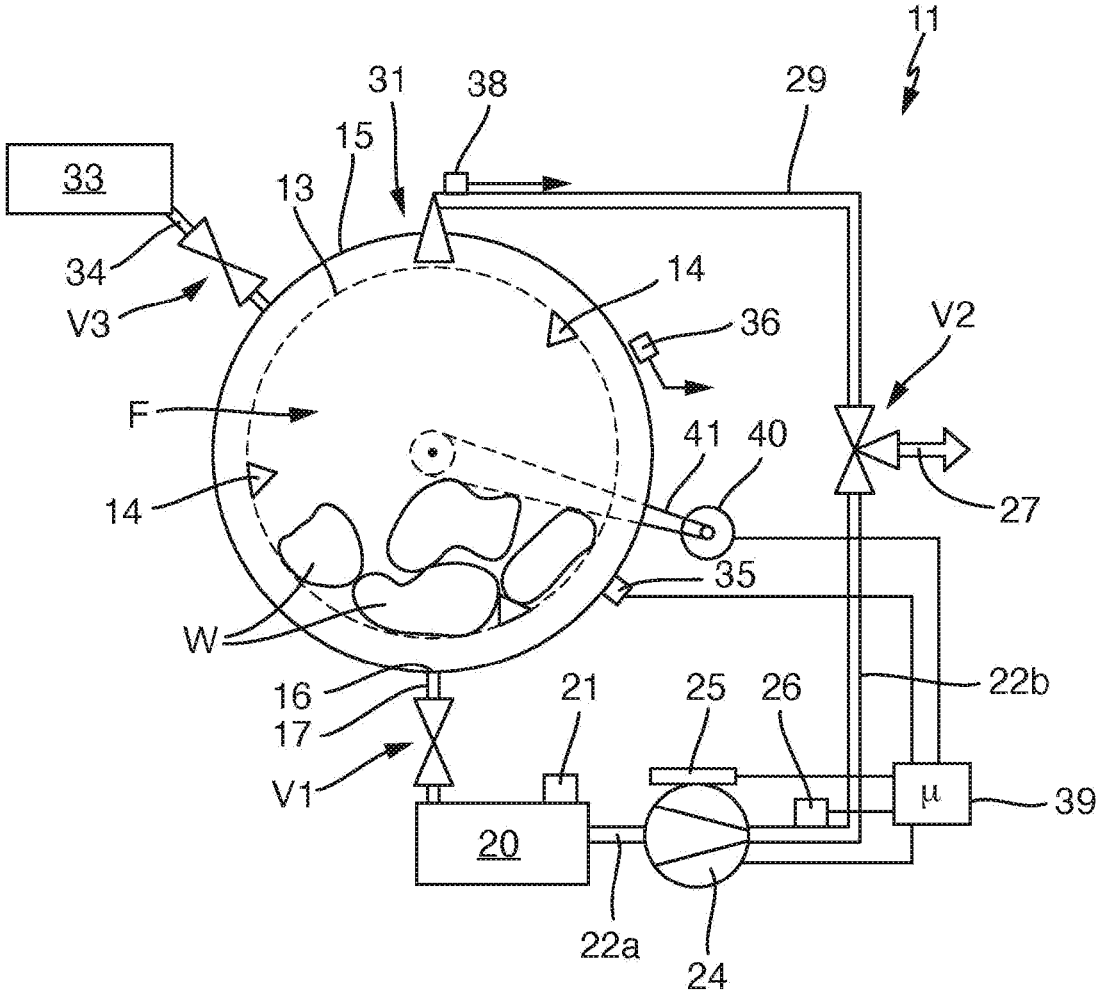
FIG. 1 shows a simplified schematic representation of a washing machine according to the invention with a water supply and several temperature sensors.

FIG. 1 shows a washing machine 11 according to the invention with a rotatable drum 13 in which laundry W is present, shown here as individual items of laundry W. Catches 14 are arranged on the inside of the drum. The drum 13 has a water-permeable outer wall, advantageously perforated as usual, and is rotatably mounted in a drum receptacle 15, here with a horizontal axis of rotation. At the bottom of the drum receptacle 15, a sump line 17 as a water pipe goes from an outlet 16 via a valve V1 to a water reservoir 20. Another pump line 22*a* leads from this water reservoir 20 to a pump 24. This pump 24 is designed as explained in the prior art mentioned at the outset, for example in accordance with DE 102011003467 A1, advantageously as an impeller pump. It has an integrated heating device 25, which is shown very schematically here. The heating device 25 serves to heat the water conveyed by the pump, in particular in the pump chamber, for which purpose it is advantageously arranged in the pump chamber itself or adjacent to a wall of the pump chamber.

Another pump line 22*b* leads from the pump 24 to a three-way valve as pump valve V2. In one valve position, water can go from the pump 24 or the pump line 22*b* to a water outlet 27 which leads out of the washing machine 11. Water can thus be removed or discharged from the washing machine 11 via the water outlet 27.

In another position of the pump valve V2, water goes from the pump line 22*b* via a supply line 29 to an injection nozzle 31 as the aforementioned inlet device, namely with a certain pressure for the water. The injection nozzle 31 is arranged at the highest point of the drum receptacle 15 and is designed in such a way that, although it does not extend directly into the rotatable drum 13, it can apply or spray or mist water F onto the laundry W arranged therein in a known manner through openings provided thereon. In this regard, reference is made to the prior art, which shows this sufficiently well.

A detergent container 33 is arranged at the top left of the drum receptacle 15, from which detergent or other additives for a washing method can be introduced into the drum receptacle 15 or onto the laundry Win the drum 13 by means of a water pipe 34 and a metering valve V3, alternatively also by means a nozzle, not shown. In yet another alternative, which will be explained below with regard to FIG. 4, detergent can be introduced either into the lowest area of the drum receptacle 15 just before the outlet 16 or into the sump line 17 so that it first mixes with the water or dissolves in it before it is applied to the laundry W. A motor 40 is provided as a drum drive for the drum 13 by means of a drive belt 41, as is known per se. The motor 40 can be controlled as desired.

FIG. 1 also shows how a first temperature sensor 35 is arranged on the outside of the drum container 15 on the outside on the right and in the lower area. The first temperature sensor 35 is advantageously a standard temperature sensor with a temperature-dependent electrical resistance, for example a PTC, an NTC or a PT100/PT1000, which can measure very quickly and very accurately in the temperature range discussed here. It is advantageously connected to the drum container 15 so that it conducts heat well. It can be arranged at a height of about 20% of the total height of the drum container 14 or the vertical height between the outlet 16 and the top point on the injection nozzle 31. When viewed from the side, it may be located in a central area between the front and rear.

Further, slightly above the first temperature sensor 35, a second temperature sensor 36 is fixed to the outside of the drum case 15 in the same manner. The second temperature sensor 36 is advantageously of identical design to the first temperature sensor 35. It is located at about 80% of the vertical height of the drum container 15. Seen from the side, it can also be arranged in a central area between front and rear. One of the two temperature sensors would also be sufficient.

Another third temperature sensor 38, which is advantageously also of identical design to the other two, is additionally arranged on the supply line 29 just before the injection nozzle 31. Its purpose is to record the temperature of the water introduced directly behind it by means of the injection nozzle 31. This can also be done in the pump.

The three temperature sensors 35, 36 and 38 are connected to a washing machine controller 39, as are the pump 24, the heater 25, the temperature sensor 26 and the motor 40. This connection is also shown for the first temperature sensor 35, but not for the others for the sake of clarity. The washing machine controller 39 can thus measure and record the temperature of the water at the respective point by means of the named temperature sensors 35, 36 and 38, but also by means of the temperature sensor 26, and can also store it if necessary. The washing machine controller 39 advantageously also has a previously described memory, not shown here, for said courses.

Figure 2:
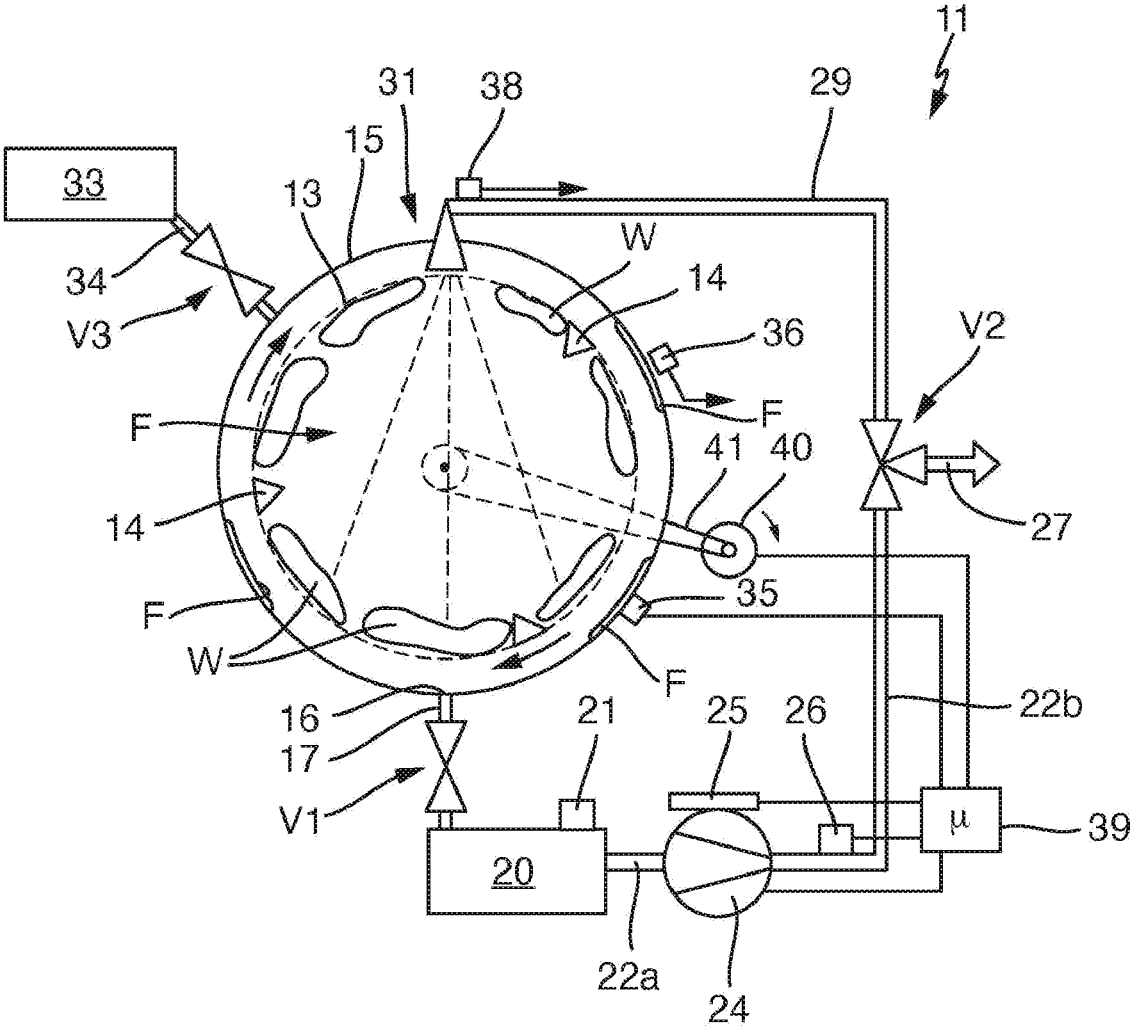
FIG. 2 shows the washing machine from FIG. 1 during the execution of the method according to the invention with application of water to the laundry in a drum.

In order to carry out the method according to the invention, as shown in FIG. 2, laundry W is first introduced into the drum 13 in the dry state, for example 3 kg of laundry, according to the definition mentioned at the outset. Either the known weight is entered manually by a user into the washing machine controller 39 or it is determined beforehand by the washing machine controller 39 of the washing machine 11 itself in a manner known from the prior art, for example when the drum 13 is rotating rapidly. Then it is moistened with, for example, 1 liter or 2 liters of water. This can, for example, first run into the drum 13 via a supply line through the detergent container 33 and the metering valve V3 and then be pumped out by the pump 24 and distributed to the laundry W by means of the injection nozzle 31 so that it is drawn into it. This can be done until the pump 24 can no longer suck in water. The retraction can be assisted by rotating the drum 13 slowly or intermittently by means of the motor 40. With the stated quantity of 3 kg of laundry, 1 liter of water will very likely be completely absorbed and little or none of it will run out of the laundry W. Thus, the washing machine controller 39 knows what weight of previously dry laundry is in the drum 13 and what quantity of water has been added to wet it. The defined quantity of 1 liter of water can be adjusted so that it is completely absorbed by 3 kg of dry cotton laundry. With more or less laundry, this quantity of water for wetting through could then be greater or less. With 3 kg of laundry made of synthetic fibers, it may not be able to absorb this defined quantity of 1 liter of water completely, so some of the water runs out again, collects at the bottom of the drum container and runs out or is pumped out. This essentially equal quantity of laundry made of synthetic fibers can then store less water and therefore has a lower thermal capacity when it is soaked through. The heat capacity when wet depends on the type of fibers in the laundry. If one can determine the heat capacity, at least qualitatively, one can deduce the type of fibers.

The temperature of this water for wetting is advantageously room temperature, i.e., about 22° C. This room temperature can also be determined by the washing machine controller 39 itself using its own temperature sensors, alternatively, for example, using the third temperature sensor 38 just before the injection nozzle 31. Thus, the washing machine controller 39 knows what thermal capacity is present in the drum 13, only the fiber type of the laundry W is not known.

Then the predefined quantity of water for a batch of warm water, here for example 11, is brought to a predefined temperature, here for example a particularly high temperature for illustration, namely 60° C. In practice, the method is advantageously carried out at the aforementioned lower temperatures, since otherwise it would not be possible in practice to avoid damage to sensitive fiber types as subgroups as a result of temperatures that are too high. Even at these lower temperatures, the temperature curves differ sufficiently. On the one hand, water can be completely sucked out of the drum container 15 via the outlet 16 and the sump line 17 through the outlet valve V1. Additional water can possibly be let in, for example again at the top via a supply line through the detergent container 33 and the metering valve V3. The stated quantity of water of 1 liter can, for example, easily be taken up in the water reservoir 20. Water can be sucked in from the water reservoir 20 by means of the pump 24 and pumped further or upwards into the pump line 22*b* and also into the feed line 29 adjoining it. The heating device 25 is operated and heats up this water; the temperature of this water can advantageously be detected via a temperature sensor arranged in the pump 24, which is also arranged on the heating device 25, for example, and/or by means of the temperature sensor 26 just behind the pump 24. The pump operation is then stopped and the water pumped up in the lines 22*b* and 29 can flow back through the pump 24 into the water reservoir 20 again. In this case, it can possibly be heated up again by means of the heating device 25. This process can be repeated several times until the desired temperature of 60° C. is reached. This represents a simple way of bringing a larger predefined quantity of water to a predefined temperature by means of the pump 24 and the heating device 25 on it, which are actually designed for heating in multiple passes. Alternatively, of course, a heating device could also be arranged on the water reservoir 20 in order to bring the predefined quantity of water therein to the predefined temperature and in a quasi-static state. This could in turn be monitored by means of a temperature sensor.

Then the drum 13 with the laundry W is set in rotation and at the same time the pump 24 pumps the predefined quantity of water at the predefined temperature through the pump line 22*b* and the supply line 29 by means of the injection nozzle 31 into the drum 13 and onto the laundry W located therein. Here, a speed can be 600 or 800 revolutions per minute, for example. This ensures that the laundry W rests in a distributed manner on the inside of the drum 13; furthermore, water impinging on the laundry W from the inside is pressed through the laundry W and can exit outside through the water-permeable wall of the drum 13. The pumping and application of the water should be relatively strong or abrupt, i.e., it should be done quickly. In FIG. 2 it can be seen how water F, which has previously passed through the laundry W, flows downwards at various points in the drum container 15 towards the outlet 16. The system, including the lines, should be designed in such a way that the water reservoir 20 is empty when water that has just been applied continues to flow from above through the outlet 16 and the sump line 17. This water can then immediately be applied to the laundry W again via the pump line 22*b* and the feed line 29 by means of the injection nozzle 31 by the continuously operated pump 24, but this time without heating. This is done for a period of 6 seconds to 10 seconds, for example, because it takes that long to apply the predefined quantity of water to the laundry W through the injection nozzle 31. Then the water can either be collected again and again first heated to the predefined temperature according to the predefined quantity of water. This heated quantity of water can then be applied again. Alternatively, water F running off the laundry W immediately can be collected again and pumped back onto the laundry W by the pump 24, which can then take place several times, for example two to five times. Thus, a total of between 2 liters and 5 liters would then have been applied to the laundry W by means of the injection nozzle 31, but only the same predefined quantity of water of 1 liter.

This quantity of water is no longer heated. In principle, however, it can also be sufficient to apply the defined heated and predefined quantity of water to the laundry once and then to record the resulting temperature curves.

Figure 3:
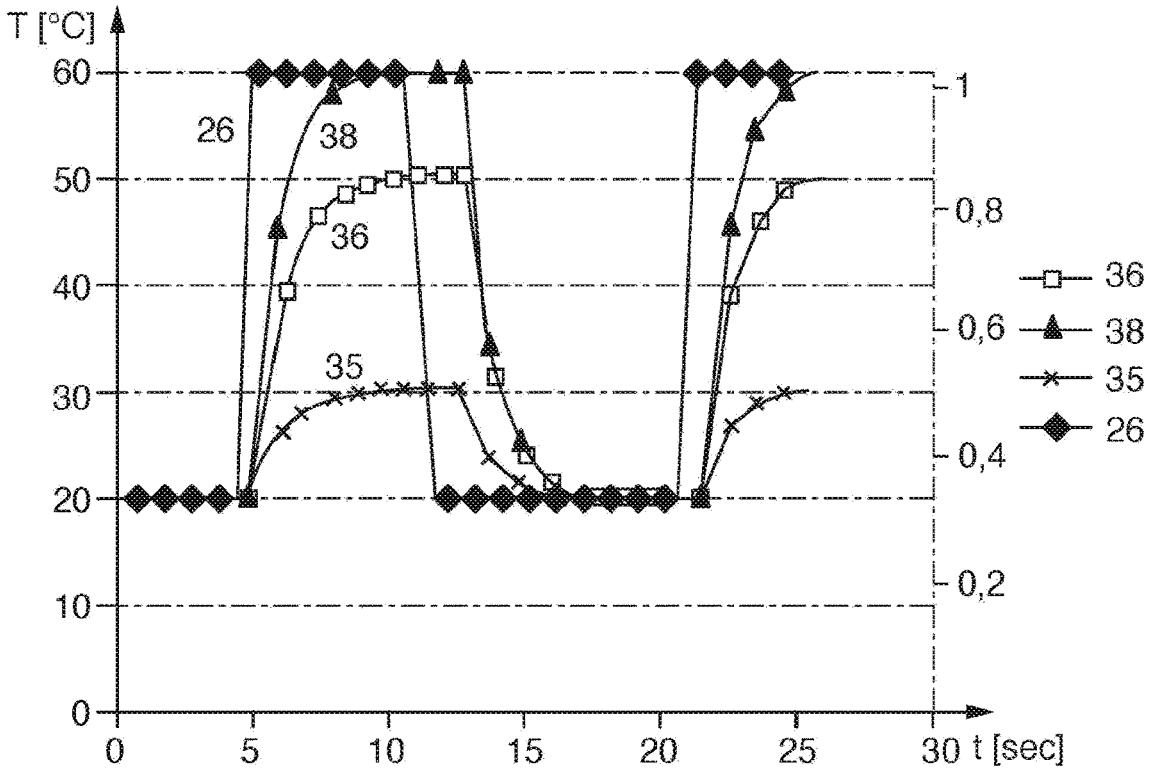
FIG. 3 shows courses of temperatures at the temperature sensors for cotton.

It is important that the three temperature sensors 35, 36 and 38 record the temperature of the water on them. For the first alternative, it is shown in FIG. 3 in the diagram over time t, how, with the curve with diamonds, the predefined quantity of water of 1 liter with the predefined temperature of 60° C. is brought into the system of the drum container 15, the drum 13, the soaked laundry W and the lines together with the pump 24, that is pumped by the pump 24 into the pump line 22*b*. Thus, at the time of t=5 seconds, there is water with a temperature of 60° C. in this system almost instantly, up to t=12 seconds. Here, the pump 24 then stops operating for a few seconds. The curve with the diamonds thus represents the temperature curve at sensor 26. The laundry W here has the fiber type of the cotton subgroup.

The temperature curves at the three temperature sensors 35, 36 and 38 are also shown. The fastest and highest temperature rise is foreseeable at the third sensor 38 at the top of the injection nozzle 31, since the thrust of warm water according to the predefined quantity of water with the predefined temperature arrives first and virtually without cooling. This temperature profile with the triangles rises very quickly to the same temperature of 60° C., corresponding to the temperature of the predefined quantity of water. If no more water is then pumped in, the temperature remains as high as long as there is water flow.

The course of the temperature at the second upper temperature sensor 36 with the squares increases somewhat more slowly and only up to about 50° C. This is because this water first has to pass through the soaked laundry items W as a result of the rotation of the drum 13 in order to then be spun onto the drum container 15 in the region of the second temperature sensor 36. This water therefore first gives off part of its thermal energy to the damp and cold laundry; the temperature rises more slowly.

It is even clearer in the case of the crossed temperature profile at the first temperature sensor 35 that this is even more time-delayed or slowed down and only reaches a maximum temperature of around 30° C. It simply takes longer here until the water that first hits the inside of the drum container 15 at the sensor 36 runs down and past the first temperature sensor 35. Furthermore, this water has already released more of its heat to the drum container 15, which is why an overall significantly lower temperature is recorded there.

The courses of the temperatures according to FIG. 3 depend, on the one hand, of course, on the delays and also the absolute heights of the structural design of the washing machine 11, especially on the lines 22*b* and 29, the injection nozzle 31 and the drum container 15 and the drum 13. These conditions are always the same for this washing machine 11 or its type, i.e., other washing machines of the same construction, regardless of the fiber type of the laundry W that is in it. Additional differences between the curves for these temperatures, in particular at the first sensor 35 and at the second sensor 36, are therefore only due to the type of laundry itself. That is why it is also advantageous if, when the quantity of laundry is known, a quantity of water adapted to this is added in order to wet the laundry according to the invention, before the actual method begins with recording the temperatures.

Figure 4:
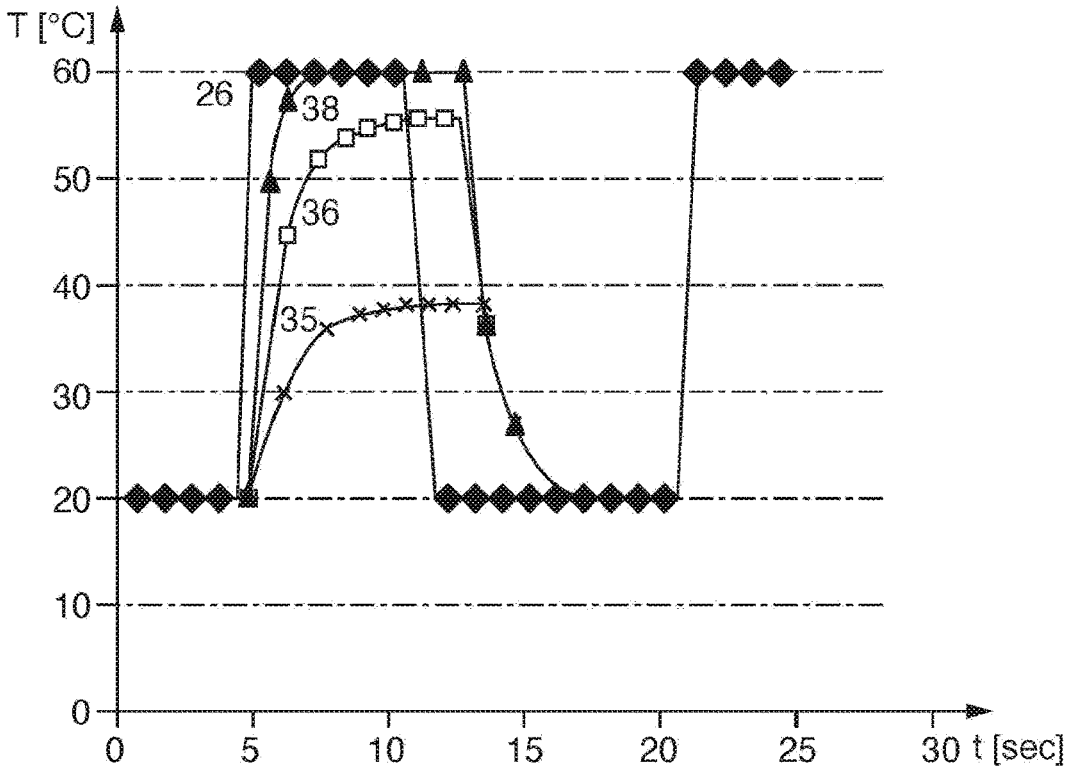
FIG. 4 shows the courses of temperatures on the temperature sensors for synthetic fibers.

FIG. 4 shows the temperature curves corresponding to FIG. 3 for laundry W of the same quantity of synthetic fibers. The laundry W here therefore has the synthetic fiber subgroup as the fiber type. Of course, the temperature curve with the diamonds up to 60° C. remains the same. The fastest and highest temperature rise is again foreseeable at the third temperature sensor 38 at the top of the injection nozzle 31. This temperature curve with the triangles rises even faster here to the same temperature of 60° C., corresponding to the temperature of the predefined quantity of water.

The course of the temperature at the second upper temperature sensor 36 with the squares increases somewhat more slowly than at the third temperature sensor 38, but much faster than in FIG. 3. In addition, the temperature rises to around 55° C. This is even clearer in the case of the crossed temperature profile at the first temperature sensor 35. It's also rising faster here than before, but it reaches a maximum temperature of around 38° C.

Since the washing machine controller 39 controls the entire method, in particular also the pump 24, it knows when temperature changes are to be expected at which temperature sensors 35, 36 and 38 and possibly also 26, so that the temperature can be recorded. Exemplary curves for the temperature profiles at the temperature sensors 35, 36 and 38 and possibly also 26 are now stored in the washing machine controller 39, depending on the quantity or weight of dry laundry, the water added for wetting, preferably including its temperature, and mainly depends on the fiber type of the laundry. If the quantity or weight of dry laundry is less, the curves for the temperature profiles rise faster, possibly also higher, and vice versa. With cotton as the type of fiber in the laundry, the curves for the temperature gradients rise more slowly, and possibly less steeply, than with synthetic fibers. Such curves for the temperature gradients can also be recorded and stored for other frequently used types of fiber with variation of the aforementioned parameters quantity or weight of dry laundry and quantity of water added for wetting, preferably including its temperature. Such fiber types can be linen, silk and wool and possibly different synthetic fibers as mentioned above.

Similar methods for using step responses in a system depending on a thermal surge or a sudden increase in temperature are known from DE 102006014515 A1, to which explicit reference is hereby made. There, the temperature in an oven is suddenly increased in order to determine the humidity inside. This humidity largely determines the heat capacity of the air inside.

The invention claimed is:

1. A method for operating a washing machine, said method comprising:

a) providing a washing machine that comprises:

a rotatable drum with a water-permeable wall including a drum drive for its rotation, a drum container in which said drum is placed, wherein said drum container surrounds said drum, an inlet device to introduce water into said drum onto laundry inside said drum, a pump and water pipes to pump water to said inlet device, at least one temperature sensor on said drum container or on a water pipe, a heating device for heating water, wherein said heating device is connected to said pump in a water-conducting manner, and a washing machine controller that is connected to said temperature sensor, said pump, said heater and said drum drive, b) placing dry laundry in said drum, c) determining, via said washing machine controller, a weight of said dry laundry in said drum, d) soaking said laundry in said drum, e) removing a water level in a lower area of said drum container by said pump pumping the lower area of the drum container such that the lower area of the drum container is completely empty of water, f) heating a predefined quantity of water to a predefined temperature by said heating device, g) pumping said predefined quantity of water with said predefined temperature through said water pipes and through said inlet device into said drum onto said laundry inside, h) pumping water out of said drum container by said pump and into said drum and onto said laundry by said water pipes and said inlet device, i) performing or repeatedly performing said aforementioned step h) until at least twice to five times said predefined quantity of water has been pumped out of said drum container and applied to said laundry, j) detecting a temperature at said temperature sensor and recording said detected temperature during said application of said water to said laundry, k) recording, in a memory of said washing machine controller, temperature curves for said temperatures detected at said temperature sensor, which detected temperatures have been recorded when carrying out said method according to said steps b) to j) with said same predefined quantity of water and said same predefined water temperature, k1) wherein several groups of temperature curves have been previously stored for different weights of said dry laundry in said drum, and k2) wherein said previously stored temperature curves are additionally subdivided into subgroups for at least two different fiber types of said laundry, wherein said method according to said steps b) to j) has been carried out for said subgroups with said same fiber type of said laundry in order to record and store said temperature curves, l) comparing, via said washing machine controller, said recorded temperature curves with said stored temperature curves and identifying a greatest temperature curve match, m) determining, based on the identified greatest temperature curve match and a corresponding matching weight of said dry laundry, said subgroup of said fiber type of said laundry in said drum, and n) performing a washing program based on said determined subgroup of said fiber type of said laundry in said drum.

2. The method according to claim 1, wherein two said temperature sensors are provided and are arranged at different vertical heights on said drum container, wherein said temperature sensors are arranged on a water pipe and/or on said drum container, with at least one said temperature sensor being arranged on said drum container.

3. The method according to claim 1, wherein said predefined quantity of water is 0.5 liters to 2 liters.

4. The method according to claim 1, wherein said predefined temperature is 25° C. to 70° C.

5. The method according to claim 1, wherein it takes 1 second to 10 seconds to completely pump said predefined quantity of water out of said drum or out of said drum container through said pump and back into said drum.

6. The method according to claim 1, wherein said drum is rotated at least temporarily or permanently, during said steps g) to i).

7. The method according to claim 6, wherein said drum is rotated at least temporarily or permanently, during said steps g) to i), at a speed of 50 to 1,800 revolutions per minute.

8. The method according to claim 6, wherein said drum is rotated so fast that said water applied to said laundry does not run down inside said drum and through said laundry down into said drum container, but, due to said rotation in said radial direction, passes through said laundry on said outside and through said wall of said drum to said drum container and to said temperature sensor.

9. The method according to claim 1, wherein said water is pumped around continuously by operating said pump.

10. The method according to claim 1, wherein, before said introduction of said predefined quantity of water with a predefined temperature via said inlet device, there is no water in said drum container below said drum in a sump that is formed at a bottom of said drum container.

11. The method according to claim 9, wherein there is also no water in a water pipe between said drum container and said pump.

12. The method according to claim 1, wherein, to heat said predefined quantity of water to said predefined temperature, water corresponding to said predefined quantity is pumped several times by said pump through said heating device without reaching said inlet device or said drum container, and either circulating or with changing direction of flow through said heating device.

13. The method according to claim 12, wherein a water container is provided in said washing machine, from and into which said pump pumps said water in and out again when heating said predefined quantity of water to said predefined temperature.

14. The method according to claim 13, wherein said water container holds at least half of said predefined quantity of water or at least said predefined quantity of water.

15. The method according to claim 1, wherein at least one said temperature sensor is arranged on said pump and/or on said heating device for determining said temperature of said water flowing through or being pumped through and/or for detecting an expended heating energy.

16. A washing machine comprising:

a rotatable drum with a water-permeable wall including a drum drive for its rotation, a drum container in which said drum is placed, wherein said drum container surrounds said drum, an inlet device to introduce water into said drum onto laundry inside, a pump and water pipes to pump water to said inlet device, at least one temperature sensor which is arranged on said drum container or on a water pipe behind said drum container, a heating device for heating water, wherein said heating device is connected to said pump in a water-conducting manner, and a washing machine controller which is connected to said temperature sensor, said pump, said heating device and said drum drive, wherein said washing machine controller has a memory and is configured for:

determining a weight of dry laundry placed in said drum, soaking said laundry in said drum, removing a water level in a lower area of said drum container by pumping, via said pump, the lower area of the drum container such that the lower area of the drum container is completely empty of water, heating, via said heating device, a predefined quantity of water to a predefined temperature, pumping, via said pump, said predefined quantity of water with said predefined temperature through said water pipes and through said inlet device into said drum onto said laundry inside, pumping, via said pump, water out of said drum container and into said drum and onto said laundry by said water pipes and said inlet device, performing or repeatedly performing said step of pumping water out of said drum container and into said drum and onto said laundry until at least twice to five times said predefined quantity of water has been pumped out of said drum container and applied to said laundry, detecting a temperature at said temperature sensor and recording said detected temperature during said application of said water to said laundry, recording, in said memory of said washing machine controller, temperature curves for said temperatures detected at said temperature sensor, which detected temperatures have been recorded with said same predefined quantity of water and said same predefined water temperature, wherein several groups of temperature curves have been previously stored for different weights of said dry laundry in said drum, and wherein said previously stored temperature curves are additionally subdivided into subgroups for at least two different fiber types of said laundry, wherein said determining, soaking, removing, heating, pumping, and detecting have been carried out for said subgroups with said same fiber type of said laundry in order to record and store said temperature curves, comparing said recorded temperature curves with said stored temperature curves and identifying a greatest temperature curve match, determining, based on the identified greatest temperature curve match and a corresponding matching weight of said dry laundry, said subgroup of said fiber type of said laundry in said drum, and performing a washing program based on said determined subgroup of said fiber type of said laundry in said drum.

17. The washing machine according to claim 16, wherein a water container is provided in said washing machine, from and into which said pump pumps said water in and out again when said predefined quantity of water is heated to said predefined temperature.

18. The washing machine according to claim 17, wherein said water container is thermally insulated.

19. The washing machine according to claim 17, wherein said water container holds at least half of said predefined quantity of water or at least said entire predefined quantity of water.

20. The washing machine according to claim 16, wherein said heating device is integrated into said pump.

21. The washing machine according to claim 16, wherein at least one said temperature sensor is arranged on said pump and/or on said heating device for determining said temperature of said water flowing through and/or for detecting an expended heating energy.

22. The washing machine according to claim 16, wherein said temperature sensor is arranged as said first temperature sensor at a level of a lower half of said drum container on an outside of said drum container, and a further temperature sensor is arranged as said second temperature sensor at a level of a upper half of said drum container on said outside of said drum container.

23. The washing machine according to claim 22, wherein said first temperature sensor is located at least 10% of a vertical height of said drum container above a lowest point of the drum container.

24. The washing machine according to claim 16, wherein one said temperature sensor is arranged on a water pipe towards said inlet device and in front of it in a direction of flow.

25. The washing machine according to claim 24, wherein one said temperature sensor is arranged on said water pipe at a distance of less than 10 cm in front of said inlet device.

* * * * *